United States Patent [19]

Boychuk

[11] 4,346,680

[45] Aug. 31, 1982

[54] APPARATUS FOR AND METHOD OF LUBRICATING A DISTRIBUTOR FOR AN INTERNAL COMBUSTION ENGINE

[76] Inventor: Zenovie Boychuk, 86 Renato Ct., Apt. 14, Redwood City, Calif. 94061

[21] Appl. No.: 161,004

[22] Filed: Jun. 19, 1980

[51] Int. Cl.[3] ..... F02P 1/00

[52] U.S. Cl. ..... 123/146.5 A; 123/196 R; 123/196 W

[58] Field of Search ..... 123/146.5 A, 196 R, 123/196 W

[56] References Cited

U.S. PATENT DOCUMENTS

| | | | |
|---|---|---|---|
| 1,915,977 | 6/1933 | Brush | 123/146.5 A |
| 1,934,199 | 11/1933 | Martin | 123/146.5 A |
| 2,773,140 | 12/1956 | Guernsey | 123/146.5 A |
| 3,678,224 | 7/1972 | Takeda | 123/146.5 A |

*Primary Examiner*—Ronald B. Cox

*Attorney, Agent, or Firm*—Warren M. Becker

[57] ABSTRACT

In an apparatus having a rotatable shaft supported by bearing members in a housing wherein said bearing members are suspended above an oil bath from which oil is splashed on said housing, an improvement for lubricating the bearing members comprising a method and means for admitting oil splashed from said bath on said housing through a wall of said housing to said shaft in the vicinity of said bearing members.

2 Claims, 2 Drawing Figures

APPARATUS FOR AND METHOD OF LUBRICATING A DISTRIBUTOR FOR AN INTERNAL COMBUSTION ENGINE

BACKGROUND OF THE INVENTION

The present invention relates to an apparatus for and method of lubricating a bearing supporting a rotating shaft in general and in particular to an apparatus for and method of lubricating the upper bearing members of a distributor for an internal combustion engine.

A distributor for an internal combustion engine typically comprises a cup-shaped housing for housing movable electrical-mechanical parts. Extending from the bottom of the cup-shaped housing there is provided an elongated tubular housing for housing a rotatable shaft for operating the movable electrical-mechanical parts. At the lower part of the tubular housing there is provided a bearing sleeve. At the upper part of the tubular housing, immediately adjacent to the cup-shaped housing, there is provided a shoulder for receiving a ring of ball bearings or an annular bearing sleeve.

The distributor housing and upper and lower bearing members described are provided for rotatably supporting the above described shaft on which is mounted a distributor plate. The distributor plate is provided for supporting the above described electrical-mechanical components of the distributor which are used in the operation of the engine in which the distributor is inserted. Forming no part of the present invention, these components are neither shown or further described herein.

When assembled in the shaft housing, the lower portion of the distributor shaft extends beyond the housing and is fitted with a gear member or the like. The gear member is provided for engaging a corresponding gear in the compartment into which the distributor is inserted such as the crankcase compartment of the engine.

During normal operation of the engine, the crankcase is filled with a predetermined quantity of engine oil for purposes of lubricating the moving parts in the engine. The lower part of the distributor including the distributor gear, lower shaft bearing and housing are immersed in the oil and adequately lubricated by the engine oil in the crankcase. In practice, however, the upper bearing comprising the upper shoulder and upper ball bearing ring or annular ring member, are not lubricated by oil from the crankcase because of their relative distance from the lower open end of the distributor shaft housing. This is because oil does not ordinarily migrate upward along the shaft to the extent necessary to lubricate these bearing parts.

Unless bearing parts are made of specific materials and are used in such a manner that they do not require lubrication, lubrication is typically required to prevent premature bearing failure and malfunction of the apparatus in which the bearing is used.

Heretofore, various proposals and attempts have been made to prevent premature failure of the upper bearing parts in conventional distributors. For example, in some of the proposals the bearing parts have been made out of materials and have been fabricated in such a way that no lubrication is necessary following manufacture. These types of bearings are typically known as permanently lublubricated bearings.

In practice, the use of permanently lubricated bearings in a distributor has not been altogether successful because of the operating conditions in which the distributor is used including gross changes in temperature and humidity and also because such bearings are relatively expensive to manufacture.

In still other proposals, grease fittings have been provided for greasing the upper bearing. In practice, however, regular maintenance procedures often result in excessive lubrication in which grease is forced up into the movable electrical parts of the distributor in the cup-shaped portion of the distributor housing causing premature failure of these parts. Because of this problem most manufacturers of distributors no longer employ such fittings.

In still another proposal for lubricating the upper bearing of a distributor, spiral grooves have been provided in the rotating shaft for propelling lubricating oil upwardly into the upper bearing in the manner of an archimedes screw. The provision of such lubricating grooves in the shaft, while suitable for the purpose, is time consuming and expensive.

For the reasons described above with respect to the disadvantages associated with the various prior known methods and apparatus for lubricating the upper bearing members in an internal combustion engine distributor, few efforts have heretofore been successful. As a consequence, upper bearing failure is considered to be one of the most prevalent reasons for distributor malfunction.

SUMMARY OF THE INVENTION

In view of the foregoing, a principal object of the present invention is an apparatus for and a method of lubricating a bearing supporting a rotating shaft substantially enclosed in a housing using available lubricating fluids.

Another object of the present invention is an apparatus for and method of lubricating the upper bearing parts of a conventional distributor used in an internal combustion engine using available lubricating fluids.

In accordance with the above objects, there is provided means for lowering the position of the upper bearing parts in the distributor shaft housing so that at least a portion of the bearing parts extend into the engine compartment in which the distributor is inserted. In the engine compartment lubricating fluid, such as oil, is splashed about by the moving parts in the compartment. Some of this oil splashes on the housing in which the rotating shaft of the distributor is housed. As a feature of the invention, one or more holes is provided in the housing for admitting oil splashed on the housing to the interior of the housing to contact the shaft.

In operation, through capillary action and the effects of the rotating shaft, the oil on the shaft is caused to migrate into the upper bearing parts thereby lubricating the bearing parts.

In practice, it is found that by a careful positioning of the bearing parts and the holes in the housing, the bearing parts do not become excessively lubricated and excess lubrication does not enter the cup-shaped portion of the distributor housing and foul the electrical components of the distributor.

BRIEF DESCRIPTION OF THE DRAWING

The above and other objects, features and advantages of the present invention will become apparent in the following detailed description of the accompanying drawing in which.

DETAILED DESCRIPTION OF THE INVENTION

Figure 1:
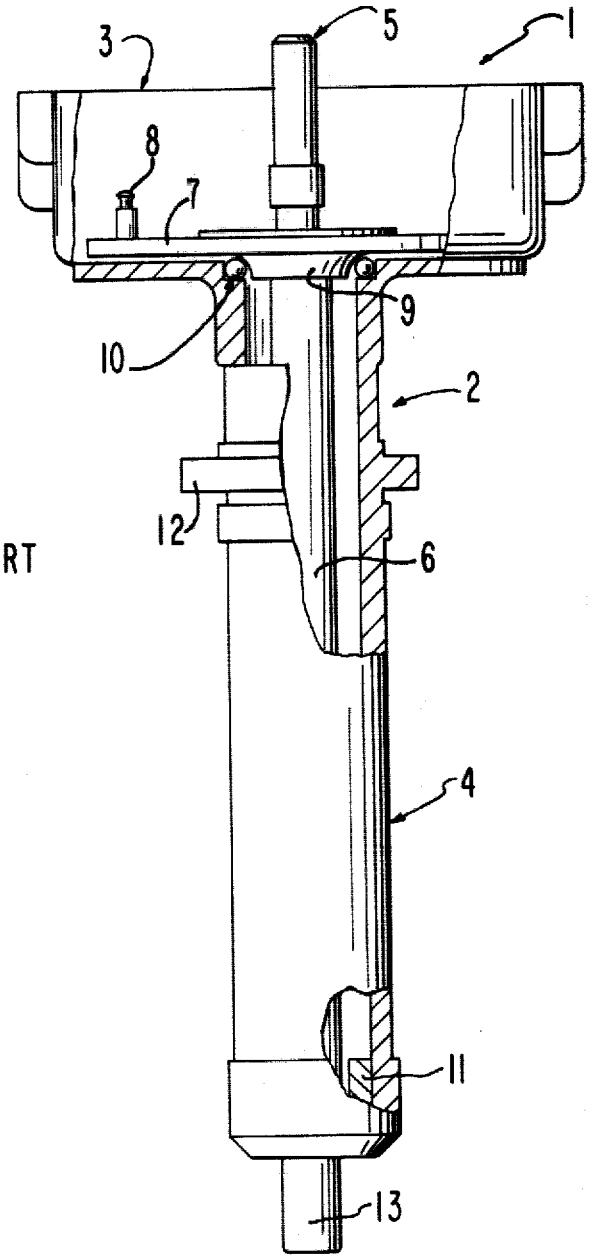
FIG. 1 PRIOR ART
FIG. 1 is a partial elevation view of a conventional prior art distributor used in an internal combustion engine.

Referring to FIG. 1, there is shown a conventional prior known distributor designated generally as 1 for use in an internal combustion engine. In the distributor 1 there is provided a housing designated generally as 2. In the housing 2 there is provided an upper cup-shaped portion 3 and lower elongated tubular shaft receiving portion 4.

Rotatably mounted in the housing 2 there is provided a distributor shaft assembly designated generally as 5. In the assembly 5 there is provided a shaft 6. Mounted to the shaft 6 at its upper end, there is provided a distributor plate 7. Extending from the top of the plate 7, there is provided a mounting fitting 8. The mounting fitting 8 is provided for mounting electrical and mechanical parts to the plate 7 for operating the engine to which the distributor 1 is attached. Forming no part of the present invention, the electrical and mechanical parts of the distributor are neither shown or further described.

Extending from the bottom of the plate 7 and concentric with the shaft 6 there is provided a bearing race 9. The race 9 is also called a bearing stop or shoulder. The race 9 is provided for providing a bearing surface for a ring of ball bearings 10 or the like.

At the lower end of the tubular housing 4 there is provided a bearing sleeve 11. The bearing sleeve 11 is provided for providing a bearing surface for the lower end of the shaft 6.

Toward the upper end of the tubular member 4 and below the cup-shaped housing 3, there is provided an annular flange 12. The annular flange 12 is provided for mounting the distributor 1 in a hole provided therefor in the engine block for inserting the lower end of the distributor 1 together with a gear attached to the end of 13 of the shaft 6 into the crankcase wherein it engages a corresponding gear for turning the distributor.

In practice, oil in the crankcase adequately lubricates the sleeve bearing 11 and the facing portion of the shaft 6 through holes in the lower part of the housing 4. This lubrication is accomplished by the agitation resulting in the splashing of the oil in the crankcase caused by the moving crankshaft, piston, rods and the like.

While considerable in magnitude, the splashing of the oil coats the exterior surface of the housing 4 but does not travel along the shaft 6 in the interior of the housing 4 in a sufficient amount to lubricate the upper bearing parts 9 and 10. As a result, in time the upper bearing parts 9 and 10 deteriorate. As the upper bearing parts 9 and 10 deteriorate, the plate 7 lowers and begins to contact the base of the cup-shaped portion of the housing 3. As the plate 7 contacts the cup-shaped portion 3, it begins to be destroyed with metal particles accumulating in the nature of fine dust among the electrical and mechanical working parts in the distributor compartment enclosed by the housing 3. When this occurs, the distributor must ordinarily be replaced.

Figure 2:
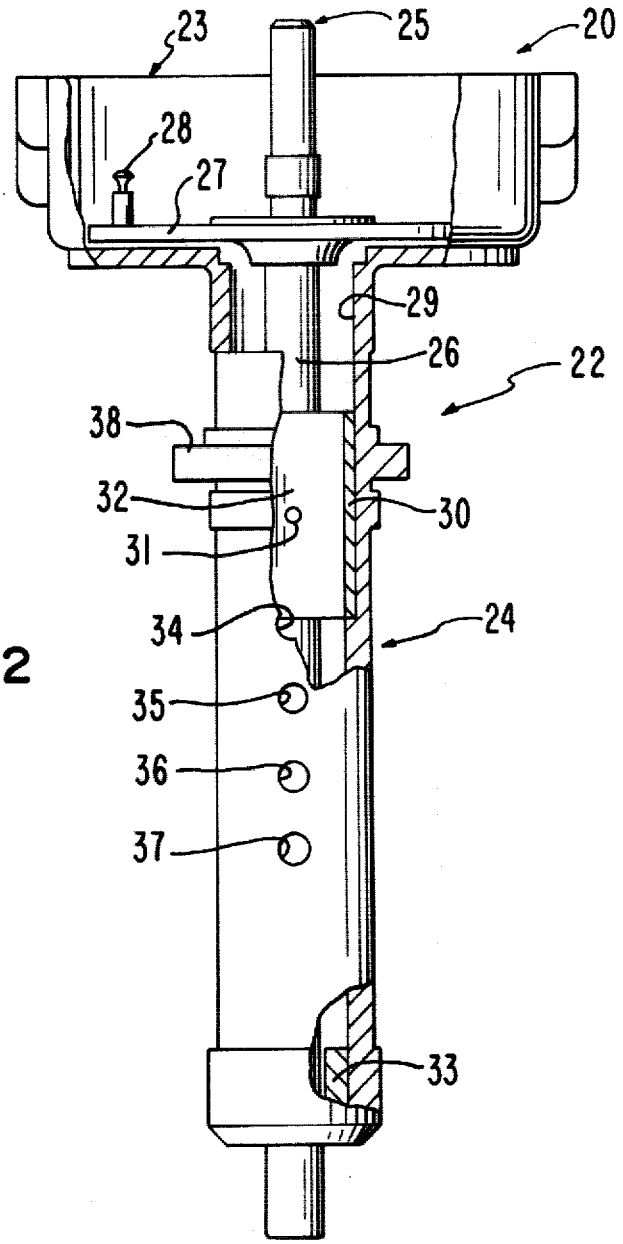
FIG. 2 is a modified distributor housing and shaft according to the present invention.

Referring to FIG. 2, there is provided in accordance with the present invention, a distributor for an internal combustion engine designated generally as 20. In the distributor 20 there is provided a housing designated generally as 22. In the housing 22 there is provided an upper cup-shaped housing member designated generally as 23 and an elongated tubular housing member designated generally as 24 extending from the base or bottom of the member 23. Rotatably mounted in the housing 22 there is provided a distributor shaft and plate assembly designated generally as 25.

In the distributor shaft and plate assembly 25 there is provided a shaft 26. Mounted to an upper portion of the shaft 26 and concentric therewith there is provided a distributor plate assembly 27. Extending from the upper surface of the plate 27 there is provided a fitting 28. The fitting 28 is provided for mounting electrical and movably mechanical parts of the distributor used for operating the engine in which the distributor is inserted. The electrical and other mechanical parts connected to the distributor plate 27 for operating the engine in which the distributor 20 is inserted, form no part of the present invention and therefore are not shown or further described herein.

Referring to the upper portion of the tubular housing member 24, the interior of the housing 24 is provided with an enlarged annular recess 29. The recess 29 is provided for receiving a bearing sleeve member 30. Mounted to the shaft 26, as by a pin 31, there is provided a cylindrical bearing member 32. Together the bearing members 30 and 32 form an upper sleeve bearing assembly for supporting the upper end of the rotatable shaft assembly 25 in place of the bearing members 9 and 10 described above with respect to the embodiment of FIG. 1.

At its lower end, there is provided in the tubular housing member 24 a sleeve member 33 corresponding to the sleeve member 11 for providing a bearing surface for the lower end of the shaft 26.

Immediately adjacent to the bearing members 30 and 32 in the tubular housing member 24 and extending downwardly therefrom, there is provided a plurality of hole members 34, 35, 36, 37. The hole members 34, 35, 36, 37 are provided for admitting to the interior of the housing member 24 to contact the shaft 26 lubricating fluids, such as oil, for lubricating the bearing members 30 and 32. The oil is splashed on the housing 24 and enters the holes 34–37 from agitation caused by the moving crankshaft, piston rods and other engine parts in the crankcase in which the distributor 20 is inserted.

For mounting the distributor 20 in the crankcase of the engine in which it is used, there is provided an annular flange 38. Flange 38 corresponds to the flange 12 of the embodiment of FIG. 1.

In practice, oil splashed on the housing 24 from the crankcase in which the distributor 20 is mounted enters the holes 34, 35, 36 and 37 and accumulates on the shaft 26. As the shaft turns, the oil on the shaft coats the bearing parts 30 and 32 and migrates as by capillary action between the interfacing surfaces of the bearing parts 30 and 32.

In a typical embodiment of the invention, the top of the sleeve and bearing members 30 and 32 is approximately 1 and $\frac{7}{8}$ inches below the base of the plate 27. The bearing members 30 and 32 are approximately 1 inch long. The hole 34 is located approximately adjacent to the bottom of the bearing members 30 and 32. Each of the holes 34, 35, 36 and 37 is approximately 0.234 inches in diameter with centers spaced approximately 0.50 inches apart. While the number, size and position of the holes 34–37 may be changed, it has been found that in a working embodiment as described above the amount of oil imparted to the bearing members 30 and 32 is sufficient for adequate lubrication thereof while at the same time the amount of oil in the housing is such that no oil reaches the electrical and other parts of the distributor in the cup-shaped housing portion 23 of the distributor 20 during normal operation.

While one embodiment of the present invention is disclosed and described, it is contemplated that various changes and modifications to the embodiment may be made by those skilled in the art without departing from the spirit and scope of the present invention. Accordingly, it is intended that the embodiment disclosed be used only for purposes of illustrating the invention and that the scope of the invention be determined by reference to the claims hereinafter provided and their equivalents.

What is claimed is:

1. A method of improving the lubrication of a conventional distributor for an internal combustion engine having an upper bearing means located in a housing for supporting a rotatable shaft, said bearing member being normally located in an upper portion of said housing outside of the engine crankcase compartment into which said distributor is inserted, comprising the steps of:

locating said upper bearing means in said housing so that at least a lower part thereof extends into said engine crankcase compartment into which said distributor is inserted; and providing a hole in said housing removed from said upper bearing means for admitting oil splashed on said housing due to rotation of a crankshaft to contact said shaft and migrates to said upper bearing means to lubricate said upper bearing means as said shaft rotates.

2. A method according to claim 1 wherein said step of locating said upper bearing means comprises the steps of:

providing an upper bearing sleeve in said housing having a portion thereof which extends into said engine compartment and providing an upper bearing member on said shaft which extends into said engine compartment in sliding relationship with said upper bearing sleeve; and said step of providing said hole in said housing near said upper bearing means comprises the step of providing said hole in said housing near said upper bearing sleeve and member.

* * * * *